US008361689B2

(12) United States Patent
Guistina et al.

(10) Patent No.: US 8,361,689 B2
(45) Date of Patent: Jan. 29, 2013

(54) NEGATIVE CHARGE CONTROL AGENTS AND THEIR PREPARATION

(75) Inventors: Robert A. Guistina, Rochester, NY (US); Dinesh Tyagi, Fairport, NY (US); Jason Morgan, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 1174 days.

(21) Appl. No.: 11/934,911

(22) Filed: Nov. 5, 2007

(65) Prior Publication Data

US 2009/0117484 A1 May 7, 2009

(51) Int. Cl.
*G03G 9/087* (2006.01)

(52) U.S. Cl. ..... 430/109.4; 430/109.5

(58) Field of Classification Search ..... 430/109.4, 430/109.5

See application file for complete search history.

(56) References Cited

U.S. PATENT DOCUMENTS 3,669,922 A * 6/1972 Bartsch et al. ..... 524/88
4,329,304 A * 5/1982 McClain ..... 264/8
5,324,612 A * 6/1994 Maeda et al. ..... 430/109.4
5,393,855 A * 2/1995 Iwamura et al. ..... 526/269
5,422,227 A * 6/1995 Hotta et al. ..... 430/285.1
5,686,218 A * 11/1997 Liebermann et al. ..... 430/109.4
6,593,041 B2 7/2003 Veregin et al.
6,709,761 B2 * 3/2004 Hirose et al. ..... 428/517
7,329,476 B2 * 2/2008 Sacripante et al. ..... 430/109.4
2005/0232665 A1 * 10/2005 Toshio et al. ..... 399/346
2006/0188801 A1 * 8/2006 Guistina et al. ..... 430/108.3
2006/0245794 A1 * 11/2006 Honda et al. ..... 399/258

* cited by examiner

*Primary Examiner* — Mark F Huff
*Assistant Examiner* — Rachel Zhang
(74) *Attorney, Agent, or Firm* — Carl F. Ruoff; Andrew J. Anderson

(57) ABSTRACT

The present invention provides an electrostatographic toner that has a condensation polymer binder having carboxylic acid end groups and an acid number of 4 or greater. The carboxylic end groups are converted to metal salts having the structure;

$$(\text{—COO}^{-1})_n\text{M}^{+n}$$

where M is selected from groups IB, IIB, IIIB, IVB, VB, or IA, IIA, IIIA, IVA, VA, VIA, VIIA and VIIIA of the periodic table and n is an integer from 1-4. The present invention also provides a developer of carrier particles and the electrostatographic toner.

13 Claims, No Drawings

NEGATIVE CHARGE CONTROL AGENTS AND THEIR PREPARATION

FIELD OF THE INVENTION

This invention relates to certain new electrostatographic toners and developers containing condensation polymer binders with carboxylic acid end groups that are reacted during extrusion processes with specific metal salts. The toners and developers obtained from the reactive extrusion process have stable triboelectric properties. More particularly, the inventive reactive extrusion process yields toners with stable negative polarity having good charging properties without unacceptable interactions with other developer or copier components. The reaction of the carboxylic acid end groups with the inventive metal salts does not add color to the toner binders rendering them exceptionally useful for color toner applications.

BACKGROUND OF THE INVENTION

In electrostatography an image comprising an electrostatic field pattern, usually of non-uniform strength, (also referred to as an electrostatic latent image) is formed on an insulative surface of an electrostatographic element by any of various methods. For example, the electrostatic latent image may be formed electrophotographically (i.e., by imagewise photo-induced dissipation of the strength of portions of an electrostatic field of uniform strength previously formed on a surface of an electrophotographic element comprising a photoconductive layer and an electrically conductive substrate), or it may be formed by dielectric recording (i.e., by direct electrical formation of an electrostatic field pattern on a surface of a dielectric material). Typically, the electrostatic latent image is then developed into a toner image by contacting the latent image with an electrostatographic developer. If desired, the latent image can be transferred to another surface before development.

One well-known type of electrostatographic developer comprises a dry mixture of toner particles and carrier particles. Developers of this type are commonly employed in well-known electrostatographic development processes such as cascade development and magnetic brush development. The particles in such developers are formulated such that the toner particles and carrier particles occupy different positions in the triboelectric continuum, so that when they contact each other during mixing to form the developer, they become triboelectrically charged, with the toner particles acquiring a charge of one polarity and the carrier particles acquiring a charge of the opposite polarity. These opposite charges attract each other such that the toner particles cling to the surfaces of the carrier particles. When the developer is brought into contact with the latent electrostatic image, the electrostatic forces of the latent image (sometimes in combination with an additional applied field) attract the toner particles, and the toner particles are pulled away from the carrier particles and become electrostatically attached imagewise to the latent image-bearing surface. The resultant toner image can then be fixed in place on the surface by application of heat or other known methods (depending upon the nature of the surface and of the toner image) or can be transferred to another surface, to which it then can be similarly fixed.

A number of requirements are implicit in such development schemes. Namely, the electrostatic attraction between the toner and carrier particles must be strong enough to keep the toner particles held to the surfaces of the carrier particles while the developer is being transported to and brought into contact with the latent image, but when that contact occurs, the electrostatic attraction between the toner particles and the latent image must be even stronger, so that the toner particles are thereby pulled away from the carrier particles and deposited on the latent image-bearing surface. If the particles do not charge quickly enough, lose their charge, or do not charge to a high enough value then they may fly off the carrier particles in an uncontrolled fashion causing high levels of toner dust in the apparatus. High levels of toner dust can cause severe damage to the electrophotographic apparatus, resulting in contaminated gears, mirrors, lenses etc.

The toner particles in dry developers often contain material referred to as a charge agent or charge-control agent, which helps to establish and maintain toner charge within an acceptable range. Many types of charge-control agents have been used and are described in the published patent literature. Charge control agents may charge toner particle positively or negatively. Charge control agents yielding toner particles with stable positive charge are more ubiquitous than those yielding toners with stable negative charge. In fact, few additives are known which yield toners with stable negative charge. Some of the known negative charge control agents are highly colored rendering them unacceptable for use in anything but black toners. All of the negative charge agents tend to be complex molecules and as such are expensive and add significant expense to the final toner product.

Additionally, some of the known charge agents will adversely interact chemically and/or physically with other developer or copier components. For example, some will interact with carrier or carrier coating materials (e.g., fluorohydrocarbon polymer coatings such as poly(vinylidene fluoride)) and lead to premature carrier aging and shortened useful developer life. Some will chemically interact with certain toner colorants to cause unacceptable hue shifts in the toner. Some being highly colored will be objectionable for use in typical color toners since such a property will also cause objectionable hue shifts. Some will interact with copier fuser rollers (e.g., rollers coated with fluorohydrocarbon polymers such as poly(vinylidene fluoride-co-hexafluoropropylene)) to cause premature failure of the copier's toner fusing system.

U.S. Pat. No. 6,593,049 discloses a toner having a resin and a charge additive that is a complex of a hard acid and a hard base. This additive is used in conjunction with a charge control agent. The present invention provides a toner that contains the charge control agent as part of the toner binder, thus, eliminating a component in the toner composition.

Another issue that affects the charging properties in toners is the extent of charge control agent dispersion. Most often these charge agents are incompatible with the toner resins and are thus hard to disperse. When small toner particles are pulverized, there are many resulting toner particles that are produced with no charge agent. This leads to a distribution of charge in toner particles that affects the developer performance. Another problems that is often seen with poorly dispersed charge agent is that in conventional melt pulverized toners, more charge agent is present on the surface of the toner. This is not only undesirable from the charging and charge uniformity point, but charge on such resulting toners is also more sensitive to relative humidity and other environmental factors.

U.S. Pat. No. 6,593,049 discloses a toner having a resin and a charge additive that is a complex of a hard acid and a hard base. This additive is used in conjunction with a charge control agent. The present invention provides a toner that contains the charge control agent as part of the toner binder, thus eliminating a component in the toner composition. When charge agent is incorporated in the backbone of the toner resin, the problems associated with charge agent incompatibility such as charge agent dispersion and the presence of charge control agent on the surface of the toner are avoided. By having the charge agent incorporated in the polymer resin, a uniform charging behavior can be expected in all resulting toner particles.

It would, therefore, be desirable to provide new dry negative polarity electrographic toners and developers containing charge control agents that perform the charge-controlling function well, while avoiding or minimizing all of the drawbacks noted above. The present invention does this.

SUMMARY OF THE INVENTION

The present invention provides an electrostatographic toner that has a condensation polymer binder having carboxylic acid end groups and an acid number of 4 or greater. The carboxylic end groups are converted to metal salts having the structure:

$$(\text{—}COO^{-1})_n M^{+n}$$

where M is selected from groups IB, IIB, IIIB, IVB, VB, or IA, IIA, IIIA, IVA, VA, VIA, VIIA and VIIIA of the periodic table and n is an integer from 1-4. The present invention also provides a developer of carrier particles and the electrostatographic toner.

DETAILED DESCRIPTION OF THE INVENTION

The invention provides new dry, particulate, negative polarity electrostatographic toners and developers containing new charge-control agents comprising specific metal salts of the carboxylic acid end groups of the toner binder polymer. The salts are formed by the reactive extrusion of specific metal carbonates with the condensation polymer binder. The following reaction occurs during the extrusion process:

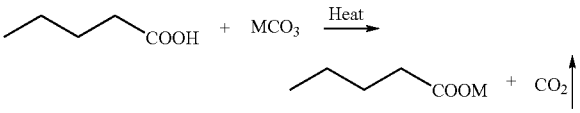

It should be stressed that the above reactions leave no unwanted by-products in the toner as the carbon dioxide is volatilized at the high extrusion temperatures and is removed from the system. Similar reactive processes can be envisioned with chloride, bromide, iodide metal salts. However, these salts give particularly noxious and dangerous by-products, namely haloacids. These acids, though removed in a manner similar to the inventive process, are quite dangerous to equipment, environment and personnel. Metal salts with less volatile acid anions (e.g. p-toluene sulfonate, sulfate, phosphate) will leave acidic contaminants in the extrusion melt which are harmful to the equipment, will degrade the condensation polymer binder and likely will impact the charging properties of a resulting toner in an unpredictable manner.

The inventive toners comprise the condensation-type polymeric binder whose acid ends are converted to metal salts that function as effective negative charge-control agents. Thus, the charge control agent is formed in situ during the extrusion process and the condensation polymer serves as both toner binder and charge control agent. The inventive developers comprise carrier particles and the inventive particulate toner as defined above.

The metal carboxylate salt end groups provide good charge-control in the inventive toners and developers. The inventive toners and developers do not exhibit unacceptably high conductivity or environmental sensitivity. The inventive toners and developers have not been found to interact unacceptably with commonly utilized toner colorants, carrier materials, or copier components such as fuser rolls. Additionally, being colorless or very low in color, the inventive materials are found to be particularly suited for application in colored toners.

It should be noted that the use of metal carboxylate salts formed from the end groups of condensation polymer toner binders employed in the toners and developers of this invention have not been described previously in the patent literature for use as negative polarity charge control agents as applied to electrostatographic toners.

The following examples illustrate the practice of this invention. They are not intended to be exhaustive of all possible variations of the invention. Parts and percentages are by weight unless otherwise indicated.

The new charge agents employed in the toners and developers of the invention can be conveniently prepared from readily available starting materials. Any condensation type polymer with carboxylic acid end groups can be used as the reactive binder polymer. Polyesters, polyamides and polyurethanes whose end groups and main chain constituents are modified to contain carboxylic acids by means known to those skilled in the art. Polyesters such as the propoxylated/ethoxylated bis-phenol-A fumarate polyesters are particularly preferred. Common metal carbonate salts, the cation of which may be chosen from Groups IB, IIB, IIIB, IVB, VB, or IA, IIA, IIIA, IVA, VA, VIA, VIIA and VIIIA of the periodic table can be employed. Cations of zinc, lithium, sodium and potassium are notably preferred. To be utilized as a charge-control agent in the electrostatographic toners of the invention, the metal acetate salt is mixed in any convenient manner (preferably by extrusion as described, for example, in U.S. Pat. Nos. 4,684,596 and 4,394,430) with an appropriate polymeric toner binder material and any other desired addenda, and the mix is then ground to desired size to form a free-flowing powder of toner particles containing the charge agent. The final toner can, but is not necessarily, surface treated with a low surface energy component such as derivatized silica or titania.

Toner particles of the invention have an average diameter between about 0.1 μm and about 100 μm, a value in the range from about 1.0 to about 15 μm being preferable for many currently used machines. However, larger or smaller particles may be needed for particular methods of development or development conditions.

Generally, it has been found desirable to add from about 0.1 to about 6 parts and preferably 0.3 to about 3.0 parts by weight of the aforementioned metal carbonate salt per 100 parts by weight of the reactive condensation polymer to obtain the improved toner composition of the present invention. Although larger or smaller amounts of a charge control agent can be added, it has been found that if amounts much lower than those specified above are utilized, the charge-control agent tends to exhibit little or substantially no improvement in the properties of the toner composition. As amounts more than about 6 parts of charge-control agent per 100 parts of polymeric binder are added, it has been found that the net toner charge exhibited by the resultant toner composition tends to be reduced. Of course, it must be recognized that the optimum amount of charge-control agent to be added will depend, in part, on the particular metal carbonate salt selected and the particular polymer with which it is reacted. However, the amounts specified herein above are typical of the useful range of charge-control agent utilized in conventional dry toner materials.

The polymers useful as toner binders in the practice of the present invention can be used alone or in combination and include those polymers conventionally employed in electrostatic toners. Useful polymers generally have a glass transition temperature within the range of from 50° C. to 120° C. Preferably, toner particles prepared from these polymers have relatively high caking temperature, for example, higher than about 60° C., so that the toner powders can be stored for relatively long periods of time at fairly high temperatures without having individual particles agglomerate and clump together. The melting point of useful polymers preferably is within the range of from about 65° C. to about 200° C. so that the toner particles can readily be fused to a conventional paper receiving sheet to form a permanent image. Especially preferred polymers are those having a melting point within the range of from about 65° C. to about 120° C. Of course, where other types of receiving elements are used, for example, metal plates such as certain printing plates, polymers having a melting point and glass transition temperature higher than the values specified above can be used.

In chemistry, acid value (or "neutralization number" or "acid number" or "acidity") is the mass of potassium hydroxide (KOH) in milligrams that is required to neutralize one gram of chemical substance. The acid number is a measure of the amount of carboxylic acid groups in a chemical compound. In a typical procedure, a known amount of sample dissolved in organic solvent is titrated with a solution of potassium hydroxide with known concentration and with phenolphthalein as a color indicator. The acid number is used to quantify the amount of acid present, for example in a polyester binder. It is the quantity of base, expressed in milligrams of potassium hydroxide that is required to neutralize the acidic constituents in 1 g of sample.

Since a polyester resin could consist of not only the carboxylic acid groups on its backbone but also any unreacted monomeric acids remaining from the polymerization, the typical measurement methods for determining the Acid Value actually measure the Total Acid Number value. Most often though, the monomeric acid is very small and the Total Acid Number value is the same as the Acid Number.

The Total Acid Number value can be deduced by a couple of different methods, e.g: by color indicator titration, by potentiometric titration.

Potentiometric Titration

The sample is normally dissolved in toluene and propanol with a little water and titrated with alcoholic potassium hydroxide (if sample is acidic). A glass electrode and reference electrode is immersed in the sample and connected to a voltmeter/potentiometer. The meter reading (in millivolts) is plotted against the volume of titrant. The end point is taken at the distinct inflection of the resulting curve corresponding to the basic buffer solution.

Color Indicating Titration

An appropriate pH color indicator e.g., Phenolphthalein, is used. Titrant is added to the sample by means of a burette. The volume of titrant used to cause a permanent color change in the sample is recorded and used to calculate the Total Acid Number or Acid Value.

The Acid Value of a polyester binder in toner is very important in the invention. Since the charging species are created by the reaction of metal salts and the carboxylic acids in polyester, presence of carboxylic groups is very significant. If there are no carboxylic acids groups present, then reaction would not be able to proceed and poor charging behavior would be observed. The charge level could be controlled by both the acid value of the polyester as well as the type of metal salts used. Thus, an optimum charging performance can be achieved by the judicious choice of the acid value of the polyester and the metal salts used.

Among the various polymers that can be employed in the toner particles of the present invention, are appropriately derivatized with carboxylic acid end groups polycarbonates, resin-modified maleic alkyd polymers, polyamides, phenol-formaldehyde polymers, and polyester condensates. Polyester binders are a preferred embodiment of the invention. Particularly preferred are polyester condensates of fumaric acid with propoxylated bis-phenol-A.

Additionally, other polyesters having the aforementioned physical properties are also useful. Among such other useful polyesters are co-polyesters prepared from terephthalic acid (including substituted terephthalic acid), a bis(hydroxyalkoxy)phenylalkane having from 1 to 4 carbon atoms in the alkoxy radical and from 1 to 10 carbon atoms in the alkane moiety (which can also be a halogen-substituted alkane) and an alkylene glycol having from 1 to 4 carbon atoms in the alkylene moiety.

Various kinds of well-known addenda (e.g., colorants, release agents, etc.) can also be incorporated into the toners of the invention. Numerous colorant materials selected from dyestuffs or pigments can be employed in the toner materials of the present invention. Such materials serve to color the toner and/or render it more visible. Of course, suitable toner materials having the appropriate charging characteristics can be prepared without the use of a colorant material where it is desired to have a developed image of low optical density. In those instances where it is desired to utilize a colorant, the colorants can, in principle, be selected from virtually any of the compounds mentioned in the Colour Index Volumes 1 and 2, Second Edition.

Included among the vast number of useful colorants are such materials as Hansa Yellow G (C.I. 11680), Nigrosine Spirit soluble (C.I. 50415), Chromogen Black ET00 (C.I. 45170), Solvent Black 3 (C.I. 26150), Fushsine N (C.I. 42510) and C.I. Basic Blue 9 (C.I. 51015). Carbon black also provides a useful colorant. The amount of colorant added may vary over a wide range, for example, from about 1 to about 20 percent of the weight of the polymer. Particularly good results are obtained when the amount is from about 1 to about 10 percent.

To be utilized as toners in the electrostatographic developers of the invention, toners of this invention can be mixed with a carrier vehicle. The carrier vehicles, which can be used with the present toners to form the new developer compositions, can be selected from a variety of materials. Such materials include carrier core particles and core particles over coated with a thin layer of film-forming resin.

The carrier core materials can comprise conductive, non-conductive, magnetic, or non-magnetic materials. For example, carrier cores can comprise glass beads; crystals of inorganic salts such as aluminum potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, oxidized iron; or mixtures or alloys of any of the foregoing. See, for example, U.S. Pat. Nos. 3,805,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See, for example, U.S. Pat. Nos. 4,042,518; 4,478,925; and 4,546,060.

As noted above, the carrier particles can be over coated with a thin layer of a film-forming resin for the purpose of establishing the correct triboelectric relationship and charge level with the toner employed. Examples of suitable resins are the polymers described in U.S. Pat. Nos. 3,547,822; 3,632,512; 3,795,618 and 3,898,170 and Belgian Patent No. 797,132. Other useful resins are fluorocarbons such as polytetrafluoroethylene, poly(vinylidene fluoride), mixtures of these, and copolymers of vinylidene fluoride and tetrafluoroethylene. See, for example, U.S. Pat. Nos. 5,545,060; 4,478,925; 4,076,857; and 3,970,571. Such polymeric fluorohydrocarbon carrier coatings can serve a number of known purposes. One such purpose can be to aid the developer to meet the electrostatic force requirements mentioned above by shifting the carrier particles to a position in the triboelectric series different from that of the up-coated carrier core material, in order to adjust the degree of triboelectric charging of both the carrier and toner particles. Another purpose can be to reduce the frictional characteristics of the carrier particles in order to improve developer flow properties. Still another purpose can be to reduce the surface hardness of the carrier particles so that they are less likely to break apart during use and less likely to abrade surfaces (e.g., photoconductive element surfaces) that they contact during use. Yet another purpose can be to reduce the tendency of toner material or other developer additives to become undesirably permanently adhered to carrier surfaces during developer use (often referred to as "scumming"). A further purpose can be to alter the electrical resistance of the carrier particles.

A typical developer composition containing the above-described toner and a carrier vehicle generally comprises from about 1 to about 20 percent by weight of particulate toner particles and from about 80 to about 99 percent by weight carrier particles. Usually, the carrier particles are larger than the toner particles. Conventional carrier particles have a particle size on the order of from about 20 to about 1200 microns, preferably 30-300 microns.

Alternatively, the toners of the present invention can be used in a single component developer, i.e., with no carrier particles.

The toner and developer compositions of this invention can be used in a variety of ways to develop electrostatic charge patterns or latent images. Such developable charge patterns can be prepared by a number of means and be carried for example, on a light sensitive photoconductive element or a non-light sensitive dielectric-surfaced element such as an insulator-coated conductive sheet. One suitable development technique involves cascading the developer composition across the electrostatic charge pattern, while another technique involves applying toner particles from a magnetic brush. This latter technique involves the use of a magnetically attractable carrier vehicle in forming the developer composition. After imagewise deposition of the toner particles, the image can be fixed, e.g., by heating the toner to cause it to fuse to the substrate carrying the toner. If desired, the un-fused image can be transferred to a receiver such as a blank sheet of copy paper and then fused to form a permanent image.

The following preparations, measurements, tests, and examples are presented to further illustrate some preferred embodiments of the toners and developers of the invention and the charge agent complexes employed therein, and to compare their properties and performance to those of toners, and developers outside the scope of the invention.

EXAMPLES

Reactive Extrusion of Carbonate Salts with Condensation Polymer Toner Binders In order to demonstrate the feasibility of this concept, several toner binders were selected for melt compounding with metal salts. Binder C was a higher Acid Value (AV) polyester from Kao Chemical Corporation having an AV of 19.6. An identical polyester to Binder C in acid value but higher molecular weight is manufactured by Reichhold Chemicals and sold as Finetone 382ES HMW. The second binder is another bis-phenol A based polyester, also manufactured by Kao Chemical Corporation and referred to Binder LLT-101. This binder has an AV of 2. Another polyester binder used in this study, referred to as Kao Binder E, has an acid value of 11. The last binder tested was a styrene-butyl acrylate (SB-77) copolymer with an acid value of zero. This toner was prepared by Kodak using the process described in U.S. Pat. No. 4,912,009.

Comparative Example 1

2.00 g of Hodogaya T-77 charge agent was dry blended with 100 g Styrene-Acrylate (SB-77) binder polymer and 6 g Pigment Blue 15:3 pigment. The uniform blend is placed on a 2-roll mill at 120° C. for twenty minutes. The entire milled mass is removed from the rolls while at temperature and allowed to cool to room temperature. The slab is coarse ground and then pulverized to a final particle size of 8 microns using a cyclone mill.

Comparative Example 2

The toner in Example 1 was repeated except the charge agent was replaced with 2 g of Bontron E-84 charge agent supplied by Orient Chemicals.

Comparative Example 3

The toner in Example 1 was repeated except the charge agent was replaced with 2 g of Zinc Carbonate.

Comparative Example 4

The toner in Example 1 was repeated except the charge agent was replaced with 2 g of Calcium Carbonate.

Comparative Example 5

The toner in Example 1 was repeated except the charge agent was replaced with 2 g of Sodium Carbonate.

Comparative Example 6

2.00 g of Hodogaya T-77 charge agent was dry blended with 100 g low acid Kao Binder LLT-101 (a propoxylated bis-phenol-A fumarate polyester) binder polymer and 6 g Pigment Blue 15:3 pigment. The uniform blend is placed on a 2-roll mill at 120° C. for twenty minutes. The entire milled mass is removed from the rolls while at temperature and allowed to cool to room temperature. The slab is coarse ground and then pulverized to a final particle size of 8 microns using a cyclone mill.

Comparative Example 7

The toner in Example 6 was repeated except the charge agent was replaced with 2 g of Bontron E-84 charge agent supplied by Orient Chemicals.

Comparative Example 8

The toner in Example 6 was repeated except the charge agent was replaced with 2 g of Sodium Carbonate.

Comparative Example 9

2.00 g of Hodogaya T-77 charge agent was dry blended with 100 g high acid Kao Binder C (a propoxylated bis-phenol-A fumarate polyester) binder polymer and 6 g Pigment Blue 15:3 pigment. The uniform blend is placed on a 2-roll mill at 120° C. for twenty minutes. The entire milled mass is removed from the rolls while at temperature and allowed to cool to room temperature. The slab is coarse ground and then pulverized to a final particle size of 8 microns using a cyclone mill.

Comparative Example 10

The toner in Example 9 was repeated except the charge agent was replaced with 2 g of Bontron E-84 charge agent supplied by Orient Chemicals.

Comparative Example 11

The toner in Example 9 was repeated except the charge agent was replaced with 2 g of Zinc Carbonate.

Comparative Example 12

The toner in Example 9 was repeated except the charge agent was replaced with 2 g of Calcium Carbonate.

Comparative Example 13

The toner in Example 9 was repeated except the charge agent was replaced with 2 g of Sodium Carbonate.

Comparative Example 14

The toner in Example 9 was repeated except the charge agent was replaced with 2 g of Lithium Carbonate.

Comparative Example 15

2.00 g of Bontron E-84 charge agent was dry blended with 100 g high acid Kao Binder E binder polymer and 6 g Pigment Blue 15:3 pigment. The uniform blend was placed on a 2-roll mill at 120° C. for twenty minutes. The entire milled mass is removed from the rolls while at temperature and allowed to cool to room temperature. The slab is coarse ground and then pulverized to a final particle size of 8 microns using a cyclone mill.

Comparative Example 16

The toner in Example 15 was repeated except the charge agent was replaced with 2 g of Calcium Carbonate.

Results

Charge and Dust Measurements

Typically a 4 gram developer sample at 10 percent toner concentration were prepared by mixing 3.6 g carrier and 4 g toner. The developer is mixed on a device that simulates the mixing that occurs in a printer developer station to charge the toner particles. The triboelectric charge of the toner is then measured after developer mixing using a MECCA device. The developer mixing can be achieved via magnetic agitation on a rotating multipole stirrer. The MECCA device includes a set of parallel plate electrodes, spaced 1 cm apart by insulative plastic spacers. A weighed developer sample (typically 0.1 grams) is placed on the lower electrode, which is connected to a power supply typically set to 2000V, with the same polarity as that of the toner to be measured. The upper electrode is connected to a coulomb-meter. The developer sample is magnetically agitated by means of a 60 Hz AC coil positioned under the lower electrode. The developer is agitated in the presence of the electric field, resulting in the toner transferring to the upper plate where the amount of charge transferred is measured with the coulomb-meter. The toner collected is weighed, the measured charge is divided by the measured weight to calculate charge per mass in units of micro-coulombs per gram, and the measured weight of the toner is divided by the starting weight of developer to calculate the toner concentration.

The amount of charge required can be controlled via the carrier coating and surface treatment of the toner with surface additives such as hydrophobic silica. But for all these measurements, a carrier with 1.5 percent silicone resin was used to measure and compare charges. Whenever absolute charges in excess of 20 micro-coulomb/g is achieved, it would be possible to make a good performing developer with that toner.

An additional embodiment of the present invention is a method to control or reduce toner "dust" levels in a development system. A fraction of toner that does not reach sufficient level of tribocharge is often thrown out from a rotating core and shell development roller when the electrostatic force is lower than the opposing centrifugal force. This is referred to as "dust" and can be measured by taking 2 grams of a 10 percent toner concentration developer to which 0.12 grams of additional toner has been added and the mixture is then gently wrist shaken for 15 seconds. This developer is then placed on a roller where the core of alternating 12 magnets is rotated at 2000 rpm under a stationary shell. The core is turned on for two minutes and the amount of toner, in milligrams, which is collected away from the roller is measured and reported as dust.

The amount of dust is not only related to the charge level but also is an indicator of the charging rate. The goal is to have as low a dust level as possible. Typically, when the dust levels are in excess of 10 mg, the contamination in the machine is severe and results in poor performing developer.

Results of evaluations of toners containing the inventive charge control agents are summarized in Table 1. Comparison to current commercially available compounds is included in the table.

TABLE 1

| | | | | −Q/m (uCoulombs/g) | | |
|---|---|---|---|---|---|---|
| Toner Example# | Carbonate Salt Added | Binder | Acid Value | 2 minute | 10 minute | Dust (mg) |
| C1 | Hodogaya T-77 | Styrene-Butyl Acrylate | 0 | −37 | −40 | 2.8 |
| C2 | Orient Bontron E-84 | Styrene-Butyl Acrylate | 0 | −22 | −33 | 6.0 |

TABLE 1-continued

| Toner Example# | Carbonate Salt Added | Binder | Acid Value | −Q/m (uCoulombs/g) 2 minute | 10 minute | Dust (mg) |
|---|---|---|---|---|---|---|
| C3 | Zinc Carbonate | Styrene-Butyl Acrylate | 0 | +3 | −24 | 104.5 |
| C4 | Calcium Carbonate | Styrene-Butyl Acrylate | 0 | +5 | −12 | 138.2 |
| C5 | Sodium Carbonate | Styrene-Butyl Acrylate | 0 | −4 | −11 | 140.6 |
| C6 | Hodogaya T-77 | Kao Binder LLT 101 | 2 | −26 | −32 | 3.1 |
| C7 | Orient Bontron E-84 | Kao Binder LLT 101 | 2 | −39 | −51 | 1.7 |
| C8 | Sodium Carbonate | Kao Binder LLT 101 | 2 | −12 | −17 | 40.7 |
| C9 | Hodogaya T-77 | Kao Binder C | 19.6 | −19 | −27 | 13.1 |
| C10 | Orient Bontron E-84 | Kao Binder C | 19.6 | −46 | −54 | 1.2 |
| 11 | Zinc Carbonate | Kao Binder C | 19.6 | −18 | −24 | 2.8 |
| 12 | Calcium Carbonate | Kao Binder C | 19.6 | −41 | −37 | 7.5 |
| 13 | Sodium Carbonate | Kao Binder C | 19.6 | −31 | −36 | 7.8 |
| 14 | Lithium Carbonate | Kao Binder C | 19.6 | −18 | −23 | 9.8 |
| C15 | Orient Bontron E-84 | Kao Binder E | 11 | −45 | −52 | 0.5 |
| 16 | Calcium Carbonate | Kao Binder E | 11 | −43 | −39 | 1.7 |

As seen from Table 1 above, it is preferred that the polymer binder have an acid value of greater than 2 and at least 4 before the dusting is at an acceptable level. It is more preferred that the acid value of the binder polymer be greater than 6 and the most preferred acid value be greater than 11.

The invention has been described in detail with particular reference to certain preferred embodiments thereof, but it will be understood that variations and modifications can be effected within the spirit and scope of the invention.

The invention claimed is:

1. An electrostatographic toner comprising: a condensation polymer binder having carboxylic acid end group and an acid value of 4 or greater, wherein the carboxylic acid end groups have been converted to metal carbonate salts having the structure:

$$(—COO^{-1})_n M^{+n}$$

where M is selected from groups IB, IIB, IIIB, IVB, VB, or IA, IIA, IIIA, IVA, VA, VIA, VIIA and VIIIA of the periodic table, and n is an integer from 1- 4, wherein the metal carbonate salts comprise from about 0.1 to about 6 parts per 100 parts by weight of the condensation polymer binder.

2. The electrostatographic toner of claim 1 wherein M is selected from the group consisting of zinc, lithium, sodium and potassium.

3. The electrostatographic toner of claim 1 wherein said condensation polymer binder is selected from the group consisting of resin-modified maleic alkyd polymers, polyamides, phenol-formaldehyde polymers, and polyester condensates.

4. The electrostatographic toner of claim 3 wherein said condensation polymer binder comprises polyester condensates of fumaric acid with propoxylated bis-phenol-A.

5. The electrostatographic toner of claim 1 comprising particles having an average diameter between about 0.1 μm and about 100 μm.

6. The electrostatographic toner of claim 1 wherein the acid value is greater than 6.

7. The electrostatographic toner of claim 1 wherein the acid value is greater than 11.

8. The electrostatographic toner of claim 1 further comprising colorant materials.

9. The electrostatographic toner of claim 1 further comprising release agents.

10. An electrostatographic developer comprising:

a condensation polymer binder having carboxylic acid end groups and an acid value of 4 or greater that have been converted to metal carbonate salts having the structure;

$$—COOM$$

where M is selected from groups IB, IIB, IIIB, IVB, VB, or IA, IIA, IIIA, IVA, VA, VIA, VIIA and VIIIA of the periodic table, wherein the metal carbonate salts comprise from about 0.1 to about 6 parts per 100 parts by weight of the condensation polymer binder; and carrier particles.

11. The electrostatographic developer of claim 8 wherein said polymer binder is selected from the group consisting of resin-modified maleic alkyd polymers, polyamides, phenol-formaldehyde polymers, and polyester condensates.

12. The electrostatographic developer of claim 10 wherein the acid value is greater than 6.

13. The electrostatographic developer of claim 10 wherein the acid value is greater than 11.

* * * * *